US012268232B2

(12) United States Patent
Franke et al.

(10) Patent No.: US 12,268,232 B2
(45) Date of Patent: Apr. 8, 2025

(54) METHODS FOR TREATING TOBACCO MATERIAL, APPARATUS FOR TREATING TOBACCO MATERIAL, TREATED TOBACCO MATERIAL AND USES THEREOF

(71) Applicant: British American Tobacco (Investments) Limited, London (GB)

(72) Inventors: Dietmar Franke, London (GB); Oliver Grüner, London (GB); Josef Knothe, London (GB); Thorsten König, London (GB); Volker Kuhl, London (GB); Matthias Link, London (GB); Frank Plückhahn, London (GB); Ruediger Hartman, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 705 days.

(21) Appl. No.: 16/976,809

(22) PCT Filed: Mar. 11, 2019

(86) PCT No.: PCT/GB2019/050663
§ 371 (c)(1),
(2) Date: Aug. 31, 2020

(87) PCT Pub. No.: WO2019/175552
PCT Pub. Date: Sep. 19, 2019

(65) Prior Publication Data

US 2021/0068443 A1 Mar. 11, 2021

(30) Foreign Application Priority Data

Mar. 12, 2018 (GB) ..... 1803905

(51) Int. Cl.
*A24B 15/10* (2006.01)
*A24B 3/04* (2006.01)
*A24B 3/12* (2006.01)

(52) U.S. Cl.
CPC ..... *A24B 15/10* (2013.01); *A24B 3/04* (2013.01); *A24B 3/12* (2013.01)

(58) Field of Classification Search
CPC ..... A24B 15/10; A24B 3/04; A24B 3/12
See application file for complete search history.

(56) References Cited

U.S. PATENT DOCUMENTS 4,513,759 A 4/1985 Wochnowski
5,383,479 A 1/1995 Winterson
(Continued)

FOREIGN PATENT DOCUMENTS

CN 2673117 Y 1/2005
EP 0481110 A1 4/1992
(Continued)

OTHER PUBLICATIONS

International Search Report for corresponding application PCT/GB2019/050663 filed Mar. 11, 2019; Report dated May 17, 2019.
(Continued)

*Primary Examiner* — Christopher M Rodd
*Assistant Examiner* — Jennifer A Kessie
(74) *Attorney, Agent, or Firm* — CANTOR COLBURN LLP

(57) ABSTRACT

The present invention provides a method of treating tobacco material comprising intermittently contacting a tobacco starting material with a heated surface to produce a dried treated tobacco material. Also provided is an apparatus for treating tobacco material. The invention also provides treated tobacco material that is seared and dried, as well as products comprising the same.

19 Claims, 2 Drawing Sheets

(56) References Cited

U.S. PATENT DOCUMENTS

| | | | | |
|---|---|---|---|---|
| 6,048,404 | A | 4/2000 | White | |
| 6,375,345 | B1 * | 4/2002 | Lepez | H05B 3/40 366/144 |
| 6,718,988 | B1 | 4/2004 | Cooper | |

FOREIGN PATENT DOCUMENTS

| | | | |
|---|---|---|---|
| EP | 0746987 | A2 | 12/1996 |
| EP | 1929888 | A1 | 6/2008 |
| EP | 3087851 | A1 | 11/2016 |
| GB | 1154460 | | 6/1969 |
| GB | 1290613 | A | 9/1972 |
| JP | S50107197 | A | 8/1975 |
| JP | H05219928 | A | 8/1993 |
| RU | 2622131 | C1 | 2/2016 |
| WO | 2009015142 | A2 | 1/2009 |
| WO | 2013131980 | A1 | 9/2013 |
| WO | 2015063485 | A1 | 5/2015 |

OTHER PUBLICATIONS

Written Opinion for corresponding application PCT/GB2019/050663 filed Mar. 11, 2019; Report dated May 17, 2019.
European Office Action for corresponding application EP19712264.1; Report dated Aug. 18, 2022.

* cited by examiner

METHODS FOR TREATING TOBACCO MATERIAL, APPARATUS FOR TREATING TOBACCO MATERIAL, TREATED TOBACCO MATERIAL AND USES THEREOF

FIELD

The present invention provides a method of treating tobacco material. Also provided is an apparatus for treating tobacco material. The invention also provides treated tobacco material, as well as products comprising the same.

BACKGROUND

Various processes and apparatus are known for drying tobacco material. These involve techniques utilising directly as well as indirectly heating the material to reduce the moisture content to a desired level.

SUMMARY

According to a first aspect of the invention, a method of treating tobacco material is provided, the method comprising intermittently contacting a tobacco starting material with a heated surface to produce a treated tobacco material with a moisture content of from 0 to about 10% oven volatiles (OV).

In some embodiments, the tobacco starting material is agitated so that it is intermittently in contact with the heated surface.

In some embodiments, the heated surface has a temperature of from at least about 100° C. to about 300° C. prior to contact with the tobacco material. In some embodiments, the heated surface has a temperature of from at least about 120° C. to about 250° C. prior to contact with the tobacco material, or from at least about 150° C. to about 300° C. prior to contact with the tobacco material.

In some embodiments, contacting the tobacco material with the heated surface heats the tobacco material to a peak temperature of from about 120° C. to about 230° C.

In some embodiments, the heated surface is a heated metal surface. In some embodiments, the surface (such as a metal surface) is heated directly.

In some embodiments, the treated tobacco material has a moisture content of no greater than about 2% OV.

In some embodiments, the tobacco starting material has a moisture content of at least about 5% OV. In some embodiments, the tobacco starting material has a moisture content of from about 5 to about 25% OV, optionally a moisture content of from about 12 to about 16% OV.

In some embodiments, tobacco material is intermittently contacted with a heated surface for a period of from at least about 1 minute to about 15 minutes. In some embodiments, tobacco material is intermittently contacted with a heated surface for a period of from at least about 2 minutes to about 10 minutes, optionally for a period of from at least about two and a half minutes to about 5 minutes.

In some embodiments, at least one of water and steam is added to the tobacco material during treatment to increase its moisture content. In some embodiments, at least one of water and steam is repeatedly added to the tobacco material during treatment.

In some embodiments, the method is a continuous process.

In some embodiments, the tobacco material is agitated by at least one of the group consisting of: a screw mechanism; a dual screw mechanism; air flow; and a rotating drum.

In some embodiments, the tobacco starting material is one or more selected from the group consisting of: cut stem, cut lamina, leaf lamina, small lamina, stem fibres, short stem and long stem.

In some embodiments, the sugar content of the treated tobacco is from about 40% to about 95% less than the sugar content of the tobacco starting material. In some embodiments, the sugar content of the treated tobacco is from about 70 to about 90% less than the sugar content of the tobacco starting material.

In some embodiments, the nicotine content of the treated tobacco is from about 10% to about 80% less that the nicotine content of the tobacco starting material. In some embodiments, the nicotine content of the treated tobacco is from about 20% to about 50% less that the nicotine content of the tobacco starting material.

In some embodiments, the ammonia content of the treated tobacco is from about 30% to about 99% less that the ammonia content of the tobacco starting material. In some embodiments, the ammonia content of the treated tobacco is from about 50% to about 90% less that the ammonia content of the tobacco starting material.

In some embodiments, the tobacco starting material is cut stem and the fill value of the treated tobacco is at least about 5% greater than the fill value of the cut stem starting material. In some embodiments, the fill value of the treated tobacco is at least about 15% greater than the fill value of the cut stem starting material. In some embodiments, the fill value of the treated tobacco is from about 30% to about 50% greater than the fill value of the cut stem starting material.

According to a second aspect of the invention, an apparatus is provided for treating treating tobacco material, the apparatus comprising a heated surface provided to intermittently contact tobacco material and to heat and dry the tobacco material to a moisture content of from 0 to about 10% oven volatiles (OV).

In some embodiments, the apparatus further comprises a means for agitating the tobacco material. In some embodiments, the means for agitating the tobacco material comprises at least one of the group consisting of: a screw mechanism; a dual screw mechanism; air flow; and a rotating drum.

In some embodiments, the heated surface has a temperature of from at least about 100° C. to about 300° C. prior to contact with the tobacco material. In some embodiments, the heated surface has a temperature of from at least about 120° C. to about 250° C. prior to contact with the tobacco material, or from at least about 150° C. to about 300° C. prior to contact with the tobacco material.

In some embodiments, contacting the tobacco material with the heated surface heats the tobacco material to a peak temperature of from about 120° C. to about 230° C.

In some embodiments, the heated surface is a heated metal surface.

In some embodiments, the heated surface is heated by a heating medium, the heating medium being water, oil, steam, electricity, or combinations thereof.

According to a third aspect of the invention, treated tobacco material is provided which has been seared and has a moisture content of from 0 to about 10% oven volatiles (OV).

In some embodiments, the treated tobacco material is obtained or obtainable by a method according to the first aspect of the invention.

In some embodiments, the treated tobacco material has reduced levels of one or more of the group consisting of:

sugars, nicotine and ammonia, compared to level in the tobacco material before it was treated.

In some embodiments, the sugar content of the treated tobacco is from about 40% to about 95%, or from about 70% to about 90%, less than the sugar content of the tobacco starting material.

In some embodiments, the nicotine content of the treated tobacco material is from about 10% to about 80%, or from about 20% to about 50%, less than the nicotine content of the tobacco material before it was contacted with the heated surface.

In some embodiments, the ammonia content of the treated tobacco material is from about 30% to about 99%, or from about 50% to about 90%, less than the ammonia content of the tobacco material before it was contacted with the heated surface.

In some embodiments, the tobacco starting material is one or more selected from the group consisting of: cut stem, cut lamina, leaf lamina, small lamina, stem fibres, short stem and long stem.

In some embodiments, the tobacco starting material is cut stem and the fill value of the treated tobacco is at least about 5% greater than the fill value of the cut stem starting material or at least about 15% greater than the fill value of the cut stem starting material. In some embodiments, the fill value of the treated tobacco is from about 30% to about 50% greater than the fill value of the cut stem starting material.

According to a fourth aspect of the invention, a tobacco industry product is provided comprising the treated tobacco material of the third aspect of the invention.

According to a fifth aspect of the invention, a use of the treated tobacco material of the third aspect of the invention is provided for the manufacture of a tobacco industry product.

BRIEF DESCRIPTION OF THE FIGURES

Embodiments of the present invention will now be described, by way of example only, with reference to the accompanying drawings, in which.

DETAILED DESCRIPTION

Figure 1:
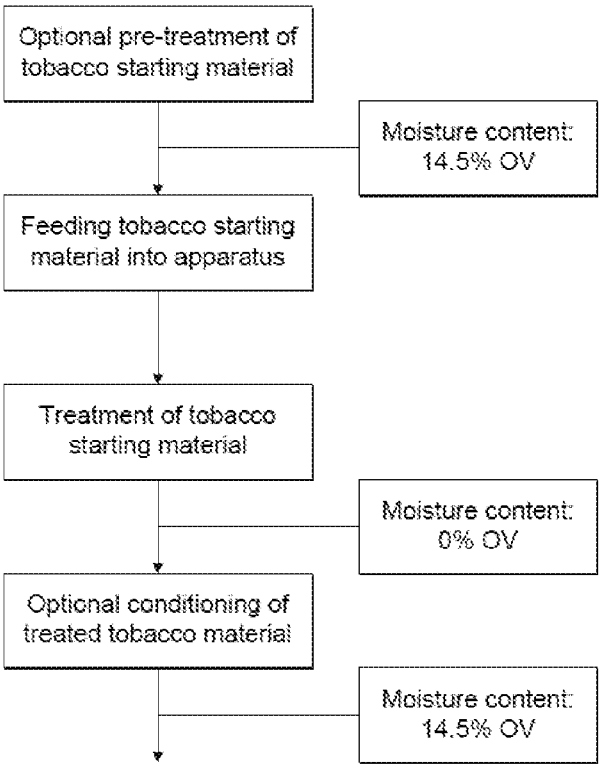
FIG. 1 shows a process flow chart of an exemplary method.

After harvesting, tobacco material can be treated in various ways to prepare the material for consumption. One of the treatments is drying. The purpose of drying is to remove moisture from the tobacco material. Other changes to the tobacco material are generally not sought or seen following known drying processes.

The determination of moisture content is important in the tobacco industry because moisture has a great influence on tobacco materials, their processing properties and on the finished product itself. When referring to "moisture" it is important to understand that there are widely varying and conflicting definitions and terminology in use within the tobacco industry. It is common for "moisture" or "moisture content" to be used to refer to water content of a material but in relation to the tobacco industry it is necessary to differentiate between "moisture" as water content and "moisture" as oven volatiles. Water content is defined as the percentage of water contained in the total mass of a solid substance. Volatiles are defined as the percentage of volatile components contained in the total mass of a solid substance. This includes water and all other volatile compounds. Oven dry mass is the mass that remains after the volatile substances have been driven off by heating. It is expressed as a percentage of the total mass. Oven volatiles (OV) are the mass of volatile substances that were driven off.

Moisture content (oven volatiles) may be measured as the reduction in mass when a sample is dried in a forced draft oven at a temperature regulated to 110° C.±1° C. for three hours 0.5 minutes. After drying, the sample is cooled in a desiccator to room temperature for approximately 30 minutes, to allow the sample to cool.

Unless stated otherwise, references to moisture content herein are references to oven volatiles (OV).

Different types of drying apparatus are known and these are usually selected based upon the desired moisture content of the resultant dried tobacco, and upon the nature of the tobacco material to be dried.

A Cased-Leaf Dryer (CLD) is one type of apparatus that dries leaf tobacco (not cut tobacco) to very low final moisture content (to as low as about 4%). The leaf tobacco that is dried using such an apparatus would usually have a starting moisture content of about 28% to about 36%. The drying process involves laying the tobacco on a band with holes. The tobacco is dried by hot air that is passed through the holes in the band. The band is not directly heated but it may be indirectly heated by the passage of hot air through the dryer. The tobacco remains in contact with the band during the drying and temperature of the heated air used to dry the tobacco leaf is generally between 8° C. and 170° C., while the vast majority is between 100° C. and 140° C. Even where the dryers are running at 170° C., the temperature of the tobacco does not exceed 100° C. as the tobacco catches fires at 'hot spots' because the hot air is still rich in oxygen.

Other known types of apparatus for drying tobacco are a Flash Tower Dryer and Fluidised Bed Dryer. The drying process involves the creation of turbulence in a stream of tobacco by the passage of air/steam mixture through the dryer. The beds of these dryers are not heated, instead the air/steam mixture is heated. Fluidised Bed Dryers are mainly used to dry cut stem which tends to have a starting moisture content in the region of 28% to 50% OV. Flash Tower Dryers, including HTD (High Temperature Dryers), HXD (High Expansion Flash Dryers) and Air Dryers, do not have a bed but also rely on heated air/steam mixture and they are mainly used to dry cut lamina which may have a starting moisture content in the region of 20% to 36% OV, and sometimes (exceptionally) to dry cut stem with a starting moisture content in the region of 28% to 50% OV. The residence time for the tobacco in a Flash Tower Dryer is very short and often just a few seconds. In contrast, tobacco may be dried in a Fluidised Bed Dryer for several minutes. The final moisture content of the processed tobacco produced by such apparatus is above about 10% OV. Tobacco temperatures in both of these dryer types are from about 50° C. to 100° C.

A further known type of apparatus for drying tobacco is a Drum Dryer. This type of dryer utilises a heated metal drum, and the drying process may be regarded as a mixture of air drying together with drying via a heated surface. The rotation of the drum causes the tobacco to tumble and creates some level of turbulence of the tobacco and air. Whilst the metal surface is heated, this is only to a temperature of about 60 to 130° C. The final moisture content of tobacco processed using this type of apparatus is higher than 10%. Typically, the moisture content of the starting material will depend on the type of tobacco material being dried. Cut lamina will have a starting moisture content of between 20% and 26%, cut tobacco stem a starting moisture content of 28% to 50%. Following a treatment period within the drum dryer of 3 to 4 minutes (for cut stem) or 4 to 7 minutes for (cut lamina), the treated tobacco has a moisture content of 12 to 15%.

In contrast to these known drying processes and apparatus, key aspects of the method of treating tobacco and of the apparatus of the invention include a combination of: drying the tobacco to a very low moisture content of 0-10% OV; and intermittently contacting the tobacco with a heated surface or surfaces.

It has been found that the exposure of tobacco to a hot surface not only dries the material to very low levels of moisture content (based in oven volatiles), but in some embodiments, the methods may lead to one or more of the following desirable chemical or physical changes:

- a significantly improved sensorial performance of cut stem;
- a significantly reduced level of sugars, for example between 70% and 90% reduction for treated cut stem and treated cut lamina;
- a significantly reduced level of nicotine, for example between 20% and 50% reduction for treated cut stem and treated cut lamina;
- a significantly decreased analytical value for ammonia, for example between 50% and 90% reduction for treated cut stem and treated cut lamina; and
- a significantly increased fill value, for example between 15% and 50% increase for treated cut stem.

The processing of tobacco material according to the methods of some embodiments of the present invention leads to chemical changes in the tobacco material. In at least some embodiments, these changes provide the treated tobacco material with improved organoleptic properties.

The organoleptic properties of tobacco material are conventionally enhanced by means of a variety of different treatments. Tobacco material can be cured to prepare the leaf for consumption. The tobacco material may be further treated, for example by aging or fermentation, to enhance the organoleptic properties of the tobacco. However, these processes can be lengthy and the quality of the resulting tobacco material can be variable. Treatments to enhance or add flavours and aromas to the tobacco material at a later stage of tobacco processing often involve the addition of one or more additives to the tobacco and can require additional processing steps and equipment, which can be costly and time-consuming.

As used herein, the term "treated tobacco material" refers to tobacco that has undergone the treatment process of the invention, and the term "untreated tobacco material" or "tobacco starting material" refers to tobacco that has not undergone the treatment process of the invention (although it may have undergone other processing).

As used herein, the term "tobacco material" includes any part and any related by-product, such as for example the leaves or stems, of any member of the genus *Nicotiana*. The tobacco material for use in the present invention is preferably from the species *Nicotiana tabacum*.

In some embodiments, the tobacco starting material is one or more selected from the group consisting of: cut stem, cut lamina, leaf lamina, small lamina, stem fibres, short stem and long stem.

Any type, style and/or variety of tobacco may be treated. Examples of tobacco which may be used include, but are not limited to, Virginia, Burley, Oriental, Comum, Amarelinho and Maryland tobaccos, and blends of any of these types. The skilled person will be aware that the treatment of different types, styles and/or varieties will result in tobacco with different organoleptic properties.

The tobacco material may be pre-treated according to known practices.

The tobacco material to be treated may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other styles, varieties and/or types. Post-curing tobacco does not comprise or consist of cut rag tobacco.

Alternatively or in addition, the tobacco material to be treated may comprise and/or consist of tobacco that has been processed to a stage that takes place at a Green Leaf Threshing (GLT) plant. This may comprise tobacco that has been re-graded, green-leaf blended, conditioned, de-stemmed or threshed (or not in the case of whole leaf), dried and/or packed.

In some embodiments, the tobacco material comprises lamina tobacco material. For example, the tobacco may comprise between about 70% and 100% lamina material. In some embodiments, the tobacco material comprises up to about 50%, up to about 60%, up to about 70%, up to about 80%, up to about 90%, or up to about 95% lamina tobacco material. In some embodiments, the tobacco material comprises up to 100% lamina tobacco material. In other words, the tobacco material may comprise substantially entirely or entirely lamina tobacco material.

Alternatively or in addition, the tobacco material may comprise at least about 50%, at least about 60%, at least about 70%, at least about 80%, at least about 90%, or at least about 95% lamina tobacco material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco. In some embodiments, the tobacco material does not comprise cut rag tobacco. In some embodiments, the tobacco is cut lamina and/or expanded tobacco (such as dry ice expanded tobacco, DIET).

In some embodiments, the tobacco material comprises stem tobacco material. The tobacco may comprise between about 90% and 100% stem material.

The tobacco material may comprise up to about 50%, up to about 60%, up to about 70%, up to about 80%, up to about 90%, or up to about 95% stem tobacco material. In some embodiments, the tobacco material comprises up to 100% stem tobacco material. In other words, the tobacco material may comprise substantially entirely or entirely stem tobacco material.

Alternatively or in addition, the tobacco material may comprise at least about 50%, at least about 60%, at least about 70%, at least about 80%, at least about 90%, or at least about 95% stem tobacco material.

In some embodiments, the tobacco material comprises a blend of lamina and stem.

In some embodiments, the tobacco material comprises expanded tobacco, such as dry ice expanded tobacco (DIET).

The intermittent contact of the tobacco with the heated surface results in a repetitive short term exposure to intense heat. In some embodiments, this intermittent contact may be achieved by agitating the tobacco. The temperature of the heated surface, and thus the temperature to which the tobacco is exposed, is significantly higher than about 100° C., and, in some embodiments, is at least about 150° C. Therefore, the intermittent contact is important in order to ensure that the tobacco is not burnt as a result of prolonged continuous exposure to surfaces at such high temperatures.

In some embodiments, the intermittent contact of the tobacco with the heated surface results in the tobacco material being seared or scorched. This is as a result of the exposure to a sudden and intense heat. This has a drying effect but also results in a treatment of the tobacco that is different to the gentle drying processes known in the prior art.

In some embodiments, the oxygen levels surrounding the tobacco during treatment may be reduced. This may have the effect of reducing the risk of 'hot spots' forming as a result of the exposure to the heated surface, and to reduce the risk of the tobacco burning. Such reduction in the oxygen level can therefore allow the tobacco to be treated at higher temperatures than in the prior art processes and apparatus. In some embodiments, the oxygen level is reduced by the application of steam.

Without wishing to be bound by any particular theory or theories, it is hypothesised that the process can be split into two phases. During the first phase, the tobacco material is being dried as a result of the exposure to the heat which drives off volatile components, including water, in a kind of steam distillation of the tobacco material. During the second phase, an effect which is referred to herein as "searing" occurs. It is during this second phase that the main chemical changes in the tobacco appear to occur.

It is hypothesised that the brief contact of the tobacco material with the heated surface, and the local searing of the tobacco, may lead to an increase in the products of the Maillard and caramelisation reactions, many of which are known to contribute to desirable organoleptic properties. This is discussed in more detail in the Example below. The Maillard reaction is a chemical reaction between amino acids and sugars, and these are present in the tobacco starting material, but are seen in reduced quantities in the treated tobacco material. It is a non-enzymatic reaction which typically occurs at temperatures of from about 140 to 165° C. In addition to the pleasing effects of the Maillard reaction products on the organoleptic properties, the reaction is also responsible for the browning of materials. It has been observed that the tobacco treated in accordance with embodiments of the present invention has a darker brown colour than the tobacco starting material.

In some embodiments, the process of treating tobacco material as described herein produces a tobacco with an enhanced flavour profile or enhanced organoleptic properties (compared to the flavour profile of tobacco which has not been treated or which has been treated using only conventional curing processes). This means that there is a reduction in off-notes or irritants, whilst retaining the taste characteristics of the tobacco as would be seen following conventional curing. As used herein, the terms "enhance" or "enhancement" are used in the context of the flavour or organoleptic properties to mean that there is an improvement or refinement in the taste or in the quality of the taste, as identified by expert smokers. This may, but does not necessarily, include a strengthening of the taste.

Reference made herein to the organoleptic properties of the tobacco material may be reference to the organoleptic properties of the tobacco material itself, for example when used orally by a consumer. Additionally, or alternatively, the reference is to the organoleptic properties of smoke produced by combusting the tobacco material, or of vapour produced by heating the tobacco material. In some embodiments, the treated tobacco material affords a tobacco product including said tobacco material with desirable organoleptic properties when said product is used or consumed.

In some embodiments, the methods of the present invention have the unexpected advantage of mitigating the negative sensorial effects of stem to the overall performance of a blend. The mouthcoating, cellulosic and 'stemmy' taste contribution is seen to be a downside of the overall stem characteristics.

It is further hypothesised that the searing also has a physical effect on the tobacco material, causing individual cells within the plant material to expand as the moisture inside them is rapidly heated and evaporates.

In some embodiments, the temperature of the heated surface is in the range of from about 100° C. to about 300° C. In some embodiments the temperature is at least about 105° C., 110° C., 115° C., 120° C., 125° C., 130° C., 135° C., 140° C., 145° C., 150° C., 155° C., 160° C., 165° C., 170° C., 175° C., 180° C., 185° C., 190° C., 195° C. or at least about 200° C. In some embodiments the temperature of the heated surface is up to about 295° C., 290° C., 285° C., 280° C., 275° C., 270° C., 265° C., 260° C., 255° C., 250° C., 245° C., 240° C., 235° C., 230° C., 225° C., 220° C., 215° C., 210° C., 205° C. or up to about 200° C. In some embodiments, the heated surface has a temperature of from at least about 120° C. to about 250° C., or from at least about 150° C. to about 300° C.

When discussing the temperature of the heated surface, reference is made herein to the temperature prior to contact with the tobacco material. This is because the contact with the tobacco material and the drying process can lead to cooling of the heated surface. Therefore, the exact temperature of the heated surface during the drying process will depend on how much "drying work" is done. For example, in the initial stages where water is being evaporated from the tobacco, a greater amount of energy will be utilised, thus leading to greater cooling of the heated surface. It is therefore the temperature of the heated surface prior to contact with the tobacco that can be readily and accurately determined.

In some embodiments, the temperature of the heated surface is controlled to minimise significant changes during the treatment process. For example, a feedback mechanism may be used to ensure that the temperature is maintained within an acceptable range, heating the surface when the temperature drops as a result of the treatment of tobacco material.

In some embodiments, it is appropriate to adjust the temperature of the heated surface according to the type of tobacco material being treated. One reason why this is appropriate is that the different tobacco materials have different starting moisture contents and so treatment will involve removing different amounts of moisture and volatiles. Also, the different tobacco materials have different physical characteristics. For example, leaf is a more fragile structure whilst tobacco stem is more woody and robust.

In some embodiments, the heated surface is metal, such as stainless steel, or any other appropriate steel and metal types with sufficient heat transfer characteristics. In other embodiments, the heated surface is made from any material with sufficient heat transfer characteristics that can be heated to the temperatures used in the methods described herein. For example, ceramic surfaces may be used.

The heated surface may, for example, be heated indirectly by a heating medium, such as a heating medium selected from the group consisting of oils, water or steam. In some embodiments, thermal oils are the preferred heating medium. Alternatively or in addition, the heated surface may be heated directly. In some embodiments, the heated surface is heated by electricity.

In some embodiments, the heated surface has a temperature prior to contact with the tobacco material in the range of from about 170° C. to about 190° C. for treating lamina tobacco. In some embodiments, the heated surface has a temperature prior to contact with the tobacco material of above 200° C. for treating stem tobacco, and optionally in the range of from about 220° C. to about 250° C.

When the tobacco material is intermittently and repeatedly contacted with the heated surface, this will heat the tobacco material. Given the high temperatures of the heated surface, the temperature of the tobacco is raised significantly. In some embodiments, as a result of the treatment method, the temperature of the tobacco material is raised to a peak temperature in the range of from about 120° C. to about 230° C. In some embodiments the peak temperature of the tobacco material is at least about 125° C., 130° C., 135° C., 140° C., 145° C., 150° C., 155° C., 160° C., 165° C., 170° C., 175° C., 180° C., 185° C., 190° C., 195° C., 200° C., 205° C., 210° C., 215° C. or at least about 220° C. In some embodiments the peak temperature of the tobacco is up to about 225° C., 220° C., 215° C., 210° C., 195° C., 190° C., 185° C., 180° C., 175° C., 170° C., 165° C., 160° C., 155° C., 150° C., 145° C., 140° C., 135° C., 130° C. or up to about 125° C. The temperature of the tobacco may be measured with suitable measurement devices, such as infrared measurement or electrical resistance thermometers.

In some embodiments, the tobacco material is heated under an inert atmosphere.

In some embodiments, an inert gas, such as nitrogen, saturated steam, carbon dioxide or mixtures thereof, is added in the apparatus to control the oxygen level and thereby steer desired chemical reaction during processing.

The treatment of the tobacco material has a drying effect and the moisture content of said tobacco material is reduced. The treated tobacco material has a moisture content of from 0% to about 10% oven volatiles (OV). In other words, the treated tobacco material has a moisture content of no greater than about 10% OV. In some embodiments, the moisture content of the treated tobacco material is no greater than 9.5%, 9%, 8.5%, 8%, 7.5%, 7%, 6.5%, 6%, 5.5%, 5%, 4.5%, 4%, 3.5%, 3%, 2.5%, 2%, 1.5%, 1% or no greater than about 0.5% OV. In some embodiments, the treated tobacco material has a moisture content of no greater than about 2% OV.

In some embodiments, the tobacco starting material has a moisture content of at least about 5% OV. In some embodiments, the moisture content of the tobacco starting material is at least about 6%, 7%, 8%, 9%, 10%, 11%, 12%, 13%, 14%, 15%, 16%, 17%, 18%, 19%, 20%, 21%, 22%, 23%, or at least about 24% OV. In some embodiments, the moisture content of the tobacco starting material is no greater than about 25%, 24%, 23%, 22%, 21%, 20%, 19%, 18%, 17%, 16%, 15%, 14%, 13%, 12%, 11%, 10%, 9%, 8%, 7%, or no greater than about 6% OV. In some embodiments, the tobacco starting material has a moisture content of from at least about 5% to about 25% OV, or from at least about 5% to about 20% OV. In some embodiments, the tobacco starting material has a moisture content of from at least about 12% to about 16% OV.

Thus, in some embodiments, the starting material to be used in the process of the present invention has a moisture content that means that the tobacco material is already dried. In some embodiments, the primary purpose of the treatment of this tobacco is not to further reduce the moisture content of the tobacco starting material, but to achieve the physical and chemical changes to the tobacco caused by the searing caused by the brief contact with the high temperature of the heated surface. In some embodiments, this effect is achieved without burning or substantially without burning the tobacco material as a result of the contact with the heated surface.

In some embodiments, the moisture content of the tobacco material may be adjusted during the treatment process by adding moisture. Moisture may be introduced to the tobacco during treatment in the form of water or steam. This may be sprayed onto the tobacco material whilst it is being intermittently contacted with a heated surface.

In some embodiments, this introduction of moisture increases the moisture content of the tobacco material by 2% to 5% OV. In some embodiments, the moisture is introduced at different positions throughout the process.

As this moisturising of the tobacco is occurring during the treatment, the moisture content will be reduced again as the moisturized tobacco contacts the heated surface. The method may include multiple additions of moisture, so that the moisture content of the tobacco material fluctuates up and down repeatedly during the treatment.

In some embodiments, the treatment involves repeatedly and intermittently contacting tobacco material with one or more heated surfaces over a treatment period of from at least about 1 minute to about 15 minutes. In some embodiments, the period for which the tobacco is intermittently contacted with the heated surface is at least about 1 minute, 2, 3, 4, 5, 6, 7, 8, 9, 10, 11, 12, 13 or at least about 14 minutes. In some embodiments, the period for which the tobacco is intermittently contacted with the heated surface is up to about 14 minutes, 13, 12, 11, 10, 9, 8, 7, 6, 5, 4, 3 or up to about 2 minutes. In some embodiments, the tobacco material is contacted with the heated surface for a total period of from at least about 2 minutes to about 10 minutes, or from at least about 2.5 minutes to about 5 minutes.

The intermittent contact may involve the tobacco being in direct and continuous contact with a heated surface for a period of up to about 5 seconds. In some embodiments, the average length of the period(s) of direct and continuous contact is from about 0.1 seconds to about 3 seconds.

Reference herein to intermittent contact of the tobacco material with the heated surface means that any part of the tobacco material is only temporarily in direct contact with the heated surface. In some embodiments, this means that the tobacco material is moved relative to the heated surface, to prevent the tobacco material coming to rest in a particular position in contact with the heated surface for too long, and/or ensuring that the same part of the tobacco material does not remain in direct contact with the heated surface for too long. Extended contact of the same part of the tobacco material with the heated surface will lead to burning which will have a detrimental effect on the physical and chemical properties of the tobacco material and will render the treated material less suitable for further use, for example in a tobacco industry product.

In some embodiments, the methods include agitating the tobacco material as it is treated. In some embodiments, an apparatus is provided which includes a means for agitating the tobacco material.

In some embodiments, it is preferred that the tobacco material is agitated by tumbling the tobacco material. This may, for example, be achieved by picking up the tobacco material being treated, lifting it and then allowing it to fall, creating a tumbling movement of the tobacco material.

In some embodiments, the movement of the tobacco material may be created by a mechanism such as one comprising one or more screws. In such an arrangement, the screw includes a helical surface encircling a shaft which is rotated, wherein the helical surface is configured to pick up tobacco material. As the shaft rotates, the helical surface scoops up at least a portion of the tobacco material being treated. This tobacco material is then carried and lifted by the rotating helical surface until the rotation of the screw allows it to fall (under gravity) away from the screw. In some embodiments, the screw or screws may be positioned to move tobacco material through a treatment chamber, as well as to agitate the tobacco material. Such an arrangement allows tobacco to be treated in a continuous manner. In some embodiments, the helical surface and/or the shaft of the screw may be heated to provide the heated surface used to treat the tobacco. Where two screws are used to move the tobacco material, these screws may be positioned in parallel and are positioned to contact and move all of the tobacco to be treated. In some embodiments, the screw may include additional paddles to assist the picking up and carrying of the tobacco material. These paddles may also be heated surfaces used to treat the tobacco material.

In other embodiments, the tobacco material may be agitated in a rotating drum. The inside of the drum may be the chamber within which the tobacco is treated. The tobacco lies inside the drum and may be picked up from the bottom of the drum and lifted as the drum rotates. The picking up of the tobacco material may be facilitated by the drum having an inner surface which is capable of maintaining contact with the tobacco material, for example by virtue of having a rough surface or protrusions, such as paddles, which scoop up the tobacco material. As the drum rotates, the tobacco in contact with the drum's inner surface is lifted until the rotation of the drum allows it to fall (under gravity) away from the drum wall and back to the bottom of the drum. This can create a tumbling and mixing of the tobacco material. The irregularities on the inner surface of the drum may help to control how long the tobacco material remains in contact with the drum wall. The irregularities may also be used to ensure that the tobacco material does not remain in contact with the drum wall as it falls (sliding back down the wall), thereby enhancing the tumbling movement of the tobacco material. The speed of rotation will also affect the tumbling motion, as will the orientation of the axis of rotation. In some embodiments, the inner surface of the drum may be the heated surface used to treat the tobacco. The drum may rotate about a horizontal or substantially horizontal axis. In other embodiments, rotation about an inclined axis may allow the tobacco to maintain contact with the drum inner surface for longer and will also move the tobacco in a longitudinal direction. Longitudinal movement of the tobacco as a result of the rotation of the drum may additionally or alternatively be achieved by having appropriately positioned and/or angled protrusions on the inner surface of the drum.

In other embodiments, the tobacco material may be agitated by air flow. For example, tobacco material is picked up and moved by air flow.

In some embodiments, the tobacco material is not agitated by the flow of air through the device. In some embodiments, the apparatus for treating tobacco material does not include means for pumping of air through the apparatus to agitate the tobacco material.

In some embodiments, the method is a continuous method. For example, tobacco starting material is continuously fed into the apparatus, is treated and then leaves the apparatus as treated tobacco material. In alternative embodiments, the method is a batch process, in which a batch of tobacco starting material is fed into the apparatus, processed to produce a batch of treated tobacco material which is removed before a new batch is processed.

In some embodiments, after treatment, the treated tobacco may be conditioned. For example, in some embodiments, moisture may be added to the treated tobacco material. In some embodiments, this is achieved by exposing the treated tobacco material to water and/or steam. In some embodiments, the moisture content is increased to above about 10% OV, or from about 10 to about 20% OV.

In some embodiments, after treatment, the treated tobacco may be cooled. In some embodiments, this may involve the use of a cooling belt, where ambient air or cooled air is passing through a layer of processed tobacco. In other embodiments, the tobacco may be cooled by any one or more of the following steps: resting, passing through a cooling cylinder, air lifting, and cooling via fluidised bed, etc.

The flow chart shown in FIG. 1 summarises exemplary processes for treating tobacco material. The tobacco starting material may optionally have undergone pre-treatment, such as the conventional primary manufacturing (PMD) processes, which include, for example, one or more of: conditioning of raw stem, subsequent rolling, cutting and expansion/drying and mixing. In some embodiments, the pre-treatment of lamina may include slicing, conditioning, casing (optional), cutting, drying, cooling and mixing.

The moisture content of the tobacco starting material may be in the region of 14.5% OV, for example. The starting material is fed into the treatment apparatus where it is treated by intermittent contact with a heated surface. During the treatment, the tobacco material is agitated to create the intermittent contact with the heated surface. The treatment results in a reduction in the moisture content to as low as 0% OV. Once the treatment of the tobacco material by intermittent contact with the heated surface has been completed, the treated tobacco material may optionally undergo conditioning. In the illustrated process, this involves adding water or steam to the treated tobacco material to increase its moisture content to in the region of 14.5% OV, for example.

The process parameters are sufficiently gentle for the treated tobacco material to maintain some or all of its physical properties. For example, the tobacco material remains sufficiently intact following treatment to allow handling and/or processing for incorporation into a tobacco-containing product, such as a smoking article. This enables the treated tobacco material to undergo handling in accordance with standard processes, in the same manner as conventional tobacco which has not undergone the processing as described herein.

Figure 2:
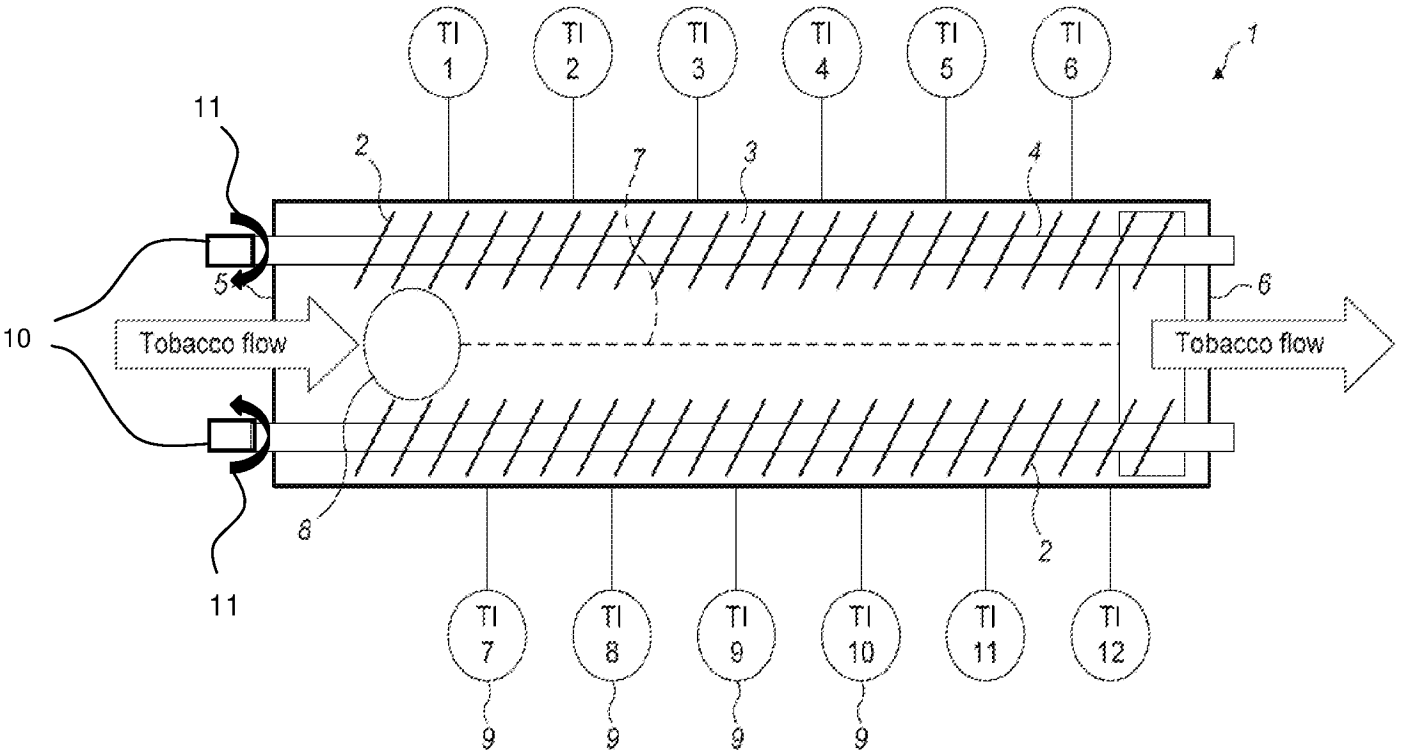
FIG. 2 is a schematic illustration of the progress of the tobacco material through an apparatus for treating tobacco material.

A specific illustrative example of an apparatus suitable for carrying out embodiments of the methods described herein is shown in FIG. 2. In this embodiment, the apparatus 1 includes two screws 2 in a dual screw arrangement. It is believed that this arrangement means that any part of the tobacco material may only be in contact with the heated surface for a period in the order of seconds at any one time as a result of the agitation or turbulence generated by the screws in the apparatus.

The tobacco material 8 is treated in the apparatus 1 including conveying screws 2 which include a helical surface 3 and shaft 4, wherein the screws 2 move the tobacco material through the treatment chamber 7 of the apparatus 1. The screws 2 are rotated and the shafts 4 of the screws 2 are rotated by a drive mechanism 11, including a motor.

The tobacco starting material enters the treatment chamber 7 via the tobacco inlet 5, whereupon the rotating screws pick up the tobacco material, tumbling it and moving it through the treatment chamber towards the tobacco outlet 6.

More specifically, a mass of tobacco material 8 enters the treatment chamber 7 through the tobacco inlet 5. As the screw 2 rotates, the tobacco material is picked up, with some of the tobacco material coming into direct contact with the helical surface 3 and possibly also the shaft 4 of the screw 2. The tobacco material is dragged along, lifted and dropped by the screw 2, so that it is both conveyed through the treatment chamber 7 and tumbled. Tobacco which has been lifted as a result of the rotating screw(s) subsequently falls into the mass of tobacco material 8 being conveyed through the chamber 7, and the mass is constantly being mixed and moved, resulting in different parts of the mass coming into contact with the screws 2 at different times.

In the illustrated embodiment, the surfaces of the screws 2 are heated and they contact the tobacco material intermittently, in accordance with the methods for treating the tobacco.

The screws 2 have metal surfaces which are heated by a heating medium which is fed into the apparatus 1 via heating medium pipes 10. In the illustrated embodiment, the heating medium is thermal oil which is heated to a desired temperature.

Only part of the tobacco material being treated will be in direct contact with a heated surface at any one time. As the tobacco is conveyed, it will be tumbled and mixed, providing agitation or turbulence of the tobacco material and the required intermittent contact with the heated surface(s). The individual contact time is believed to be no more than a few seconds at a time. The dynamics of the tobacco flow ensures a homogenous treatment of the entire tobacco mass, induced by the shape of the screws.

In the illustrated apparatus, the treatment chamber may be divided into different temperature zones 9. These represent different sections of the screws and these may be separately heated. Therefore, the apparatus can be configured to have surfaces that are heated to varying temperatures. In some embodiments, it may be desirable to control the drying and the searing phases of the treatment by exposing the tobacco to heated surfaces having different temperatures at different points in the treatment process.

The treated tobacco according to the present invention may be used in a tobacco industry product. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, lozenges and gum. This list is not intended to be exclusive, but merely illustrates a range of products which are made and sold in the tobacco industry.

The treated tobacco material may be incorporated into a smoking article. As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products.

The treated tobacco material may be used for roll-your-own tobacco and/or pipe tobacco.

The treated tobacco material may be incorporated into a smokeless tobacco product. 'Smokeless tobacco product' is used herein to denote any tobacco product which is not intended for combustion. This includes any smokeless tobacco product designed to be placed in the oral cavity of a user for a limited period of time, during which there is contact between the user's saliva and the product.

The treated tobacco material may be blended with one or more tobacco materials before being incorporated into a smoking article or smokeless tobacco product or used for roll-your-own or pipe tobacco.

EXAMPLES

Methods according to the invention were carried out on Cut Expanded Stem (CES) having a (starting) moisture content of 14.5% OV. A mass of tobacco particles is used as the infeed material and is treated by the methods using an apparatus as shown in FIG. 2.

The process can be described as exposing the particles of tobacco (stem) to hot metal surfaces for seconds, before the individual particles 'fall' back into the overall mass of tobacco material being treated.

The residence time of the mass of tobacco particles within the apparatus (and therefore the treatment period) is between 1 and 5 minutes. The heated metal surfaces are heated by a jacket which is heated as well as the screws, bringing the heated surfaces to the desired temperature, via synthetic oil.

Three different temperature scenarios were tested, namely: 230° C., 240° C. and 250° C. This means that the heating medium (oil) temperature used to heat the heated surfaces was set to these temperatures. This leads to different temperatures in different parts of the apparatus.

The figures and parameters provided in Table 1 below reflect the individual temperatures throughout the treatment process when the heating medium (oil) temperature is set to 250° C.

TABLE 1

| Parameter | Value |
|---|---|
| Residence time | 180 seconds |
| Set Point temperature | 250° C. |
| Jacket temperature @ exit (14) | 237° C. |
| Screw 1 temperature @ exit | 240° C. |
| Screw 2 temperature @ exit | 240° C. |
| Temperature sensor 1 | 125-147° C. |
| Temperature sensor 2 | 137-164° C. |
| Temperature sensor 3 | 162-180° C. |
| Temperature sensor 4 | 160-187° C. |
| Temperature sensor 5 | 177-192° C. |
| Temperature sensor 6 | 173-198° C. |
| Temperature sensor 7 | 129-151° C. |
| Temperature sensor 8 | 151-183° C. |
| Temperature sensor 9 | 148-186° C. |
| Temperature sensor 10 | 166-189° C. |
| Temperature sensor 11 | 171-195° C. |
| Temperature sensor 12 | 187-204° C. |

In the experiments, the tobacco was treated by processes involving residence times (or treatment periods) of around 2 to 3 minutes and a rate of throughput of tobacco material of around 50 kg/h of cut stem having a moisture content of approximately 14.5% OV.

The process can be split into two different phases. Throughout the first phase, the stem particles are losing their moisture. At a heating medium (oil) temperature of 250° C. the stems have a moisture content of 0% OV after approximately 1 minute. The second phase occurs for the remainder of the treatment and the effect has been termed "searing". Throughout this second phase the main changes are happening.

Table 2 compares the chemical make up of untreated tobacco with that which is treated in an apparatus which is heated to different heating medium temperatures.

TABLE 2

| Tobacco properties | Reference stem | 230° C. | 240° C. | 250° C. |
|---|---|---|---|---|
| Nicotine [% DM] | 0.62 | 0.43 | 0.36 | 0.25 |
| Sugars [% DM] | 13.6 | 5.8 | 3.5 | 2.2 |
| Nitrate [% DM] | 1.61 | 1.65 | 1.64 | 1.92 |
| Ammonium [% DM] | 0.07 | 0.03 | 0.02 | 0.01 |
| Chloride [% DM] | 2.32 | 2.4 | 2.41 | 2.47 |
| Fill value (corrected) [ml/g] | 5.8 | 6.1 | 6.7 | 7 |
| Fill value (measured) [ml/g] | 5.4 | 5.4 | 6 | 7.5 |
| OV [%] | 14.5 | 15.1 | 15. | 12.5 |

As may be seen from Table 2, the nicotine content of the treated tobacco is reduced by more than 50% at a heating medium temperature of 250° C., total sugars and ammonia by more than 80%. The increase in chloride content reflects a loss of overall organic matter and the significant increase in fill value indicates the changes in the cell structure of the treated tobacco.

The data shows that the tobacco material undergoes significant changes throughout processing.

It has been shown that these changes translate into changes in the organoleptic properties of the processed material, which are discernible in the smoke produced when the treated tobacco is combusted, for example in a cigarette. The organoleptic properties of this smoke are described in very positive terms by expert smokers, indicating that the tobacco treatment leads to the production of the treated material with beneficial and desirable properties. This is both in terms of the reduction in some undesirable tobacco constituents, and improved organoleptic properties.

In order to address various issues and advance the art, the entirety of this disclosure shows by way of illustration various embodiments in which the claimed inventions may be practiced and provide for superior methods, apparatus and treated tobacco materials and extracts therefrom. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of treating tobacco material comprising intermittently contacting a tobacco starting material with a heated surface to produce a treated tobacco material with a moisture content of from 0 to about 10% oven volatiles (OV), wherein the contact with the heated surface exposes the tobacco material to sudden and intense heat to cause local searing or scorching of the tobacco and wherein the tobacco material is agitated by a heated screw mechanism, wherein the heated screw mechanism comprises a helical surface encircling a shaft which is rotated, the helical surface being configured to scoop up and lift at least a portion of the tobacco material being treated as the screw mechanism rotates, to carry the tobacco material and then to allow it to fall away from the screw, so that the tobacco material is in direct and continuous contact with the heated surface for a period of up to about 5 seconds, wherein the heated surface has a temperature of from at least about 135° C. to about 190° C. prior to contact with the tobacco material.

2. The method as claimed in claim 1, wherein the tobacco starting material is agitated so that it is intermittently in contact with the heated surface.

3. The method as claimed in claim 1, wherein contacting the tobacco material with the heated surface heats the tobacco material to a peak temperature of from about 120° C. to about 230° C.

4. The method as claimed in claim 1, wherein the heated surface is a heated metal surface.

5. The method as claimed in claim 1, wherein the treated tobacco material has a moisture content of no greater than about 2% OV.

6. The method as claimed in claim 1, wherein the tobacco starting material has a moisture content of at least about 5% OV.

7. The method as claimed in claim 1, wherein tobacco material is intermittently contacted with a heated surface for a period of from at least about 1 minute to about 15 minutes.

8. The method as claimed in claim 1, wherein at least one of water and steam is added at least once to the tobacco material during treatment to increase its moisture content.

9. The method as claimed in claim 1, wherein the method is a continuous process.

10. The method as claimed in claim 1, wherein the tobacco material is agitated by a dual screw mechanism.

11. The method as claimed in claim 1, wherein the tobacco starting material is one or more selected from the group consisting of: cut stem, cut lamina, leaf lamina, small lamina, stem fibres, short stem and long stem.

12. The method as claimed in claim 1, wherein the sugar content of the treated tobacco is from about 40% to about 95% less than the sugar content of the tobacco starting material.

13. The method as claimed in claim 1, wherein the nicotine content of the treated tobacco is from about 10% to about 80% less that the nicotine content of the tobacco starting material.

14. The method as claimed in claim 1, wherein the ammonia content of the treated tobacco is from about 30% to about 99% less that the ammonia content of the tobacco starting material.

15. The method as claimed in claim 1, wherein the tobacco starting material is cut stem and wherein the fill value of the treated tobacco is at least about 5% or at least about 15% greater than the fill value of the cut stem starting material.

16. An apparatus for treating tobacco material, comprising a heated surface provided to intermittently contact tobacco material and to heat and dry the tobacco material to a moisture content of from 0 to about 10% oven volatiles (OV), wherein the contact with the heated surface exposes the tobacco material to sudden and intense heat to cause local searing or scorching of the tobacco, wherein the tobacco material is agitated by a heated screw mechanism, wherein the heated screw mechanism comprises a helical surface encircling a shaft which is rotated, the helical surface being configured to scoop up and lift at least a portion of the tobacco material being treated as the screw mechanism rotates, to carry the tobacco material and then to allow it to fall away from the screw, and wherein the tobacco material is in direct and continuous contact with the heated surface for a period of up to about 5 seconds, wherein the heated surface has a temperature of from at least about 135° C. to about 190° C. prior to contact with the tobacco material.

17. The apparatus as claimed in claim 16, wherein the means for agitating the tobacco material comprises a dual screw mechanism.

18. The apparatus as claimed in claim 16, wherein the heated surface is a heated metal surface.

19. The apparatus as claimed in claim 16, wherein the heated surface is heated by a heating medium, the heating medium being water, oil, steam, electricity, or combinations thereof.

* * * * *